US009160083B2

(12) United States Patent
Chastain et al.

(10) Patent No.: US 9,160,083 B2
(45) **Date of Patent: *Oct. 13, 2015**

(54) COAXIAL CONNECTOR GROUNDING INSERTS

(71) Applicant: PerfectVision Manufacturing, Inc., Little Rock, AR (US)

(72) Inventors: Robert J. Chastain, Maumelle, AR (US); Glen David Shaw, Conway, AR (US)

(73) Assignee: PerfectVision Manufacturing, Inc., Little Rock, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,956

(22) Filed: Oct. 7, 2013

(65) Prior Publication Data

US 2014/0298650 A1 Oct. 9, 2014

Related U.S. Application Data

(63) Continuation of application No. 13/373,782, filed on Nov. 30, 2011, now Pat. No. 8,556,654.

(51) Int. Cl.
*H01R 9/05* (2006.01)
*H01R 43/00* (2006.01)

(52) U.S. Cl.
CPC ..... *H01R 9/0527* (2013.01); *H01R 43/00* (2013.01); *Y10T 29/49208* (2015.01)

(58) Field of Classification Search
CPC ..... H01R 2102/00; H01R 4/646
USPC ..... 439/578–585, 99, 98
See application file for complete search history.

(56) References Cited

U.S. PATENT DOCUMENTS

| | | | | | |
|---|---|---|---|---|---|
| 2,280,728 | A | * | 4/1942 | Strelb | 439/827 |
| 2,757,351 | A | * | 7/1956 | Klostermann | 439/583 |
| 3,184,706 | A | | 5/1965 | Atkins | |
| 3,292,136 | A | | 12/1966 | Somerset | |
| 3,293,136 | A | * | 12/1966 | Harris | 376/264 |
| 3,332,052 | A | | 7/1967 | Rusinyak | |
| 3,448,430 | A | * | 6/1969 | Kelly | 439/607.52 |
| 3,665,371 | A | | 5/1972 | Cripps | |
| 3,671,922 | A | | 6/1972 | Zerlin | |
| 3,678,445 | A | | 7/1972 | Brancaleone | |
| 3,681,739 | A | | 8/1972 | Kornick | |
| 3,739,076 | A | | 6/1973 | Schwartz | |
| 3,835,442 | A | * | 9/1974 | Anderson et al. | 439/86 |
| 3,835,443 | A | | 9/1974 | Arnold | |

(Continued)

*Primary Examiner* — Gary Paumen

(74) *Attorney, Agent, or Firm* — Stephen D. Carver; Robert E. Fahr, Jr.

(57) ABSTRACT

Axially compressible, F-connectors for conventional installation tools for interconnection with coaxial cable include grounding inserts for establishing electrical continuity despite inadequate nut tightening. The connector has a rigid nut, a post penetrating the nut, a tubular body, and an end cap. The conductive post coaxially extends through the connector, linking the nut and body. A post end penetrates the coaxial cable. Internal grounding inserts comprise a circular band coaxially engaging the post and portions on the band engaging the nut. Multiple radially spaced apart spring clips defined around the band grasp a flange portion of the post. The band is seated within a ring groove within the nut, making electrical contact. An alternative insert comprises a tubular band for contacting the post and an integral skirt abutting the nut's internal ring groove and contacting a portion of the socket to which the connector is coupled.

5 Claims, 9 Drawing Sheets

(56) References Cited

U.S. PATENT DOCUMENTS

| | | | | | |
|---|---|---|---|---|---|
| 4,106,839 | A | | 8/1978 | Cooper | |
| 4,128,293 | A | * | 12/1978 | Paoli | 439/843 |
| 4,330,166 | A | * | 5/1982 | Cooper et al. | 439/607.18 |
| 4,423,919 | A | | 1/1984 | Hills | |
| 4,426,127 | A | | 1/1984 | Kubota | |
| 4,531,805 | A | | 7/1985 | Werth | |
| 4,678,445 | A | * | 7/1987 | Monreal | 441/72 |
| 4,703,988 | A | | 11/1987 | Raux | |
| 4,808,128 | A | * | 2/1989 | Werth | 439/607.5 |
| 4,979,911 | A | | 12/1990 | Spencer | |
| 5,002,503 | A | | 3/1991 | Campbell | |
| 5,066,248 | A | | 11/1991 | Gaver, Jr. | |
| 5,083,943 | A | | 1/1992 | Tarrant | |
| 5,683,263 | A | | 11/1997 | Hsu | |
| 5,722,856 | A | | 3/1998 | Fuchs | |
| 5,769,652 | A | | 6/1998 | Wider | |
| 5,975,951 | A | | 11/1999 | Burris | |
| 6,332,815 | B1 | | 12/2001 | Bruce | |
| 6,406,330 | B2 | * | 6/2002 | Bruce | 439/607.19 |
| 6,716,062 | B1 | | 4/2004 | Palinkas | |
| 7,114,990 | B2 | | 10/2006 | Bence | |
| 7,479,035 | B2 | * | 1/2009 | Bence et al. | 439/583 |
| 7,507,117 | B2 | | 3/2009 | Amidon | |
| 7,753,705 | B2 | * | 7/2010 | Montena | 439/277 |
| 7,845,976 | B2 | | 12/2010 | Matthews | |
| 7,892,005 | B2 | | 2/2011 | Haube | |
| 7,892,024 | B1 | | 2/2011 | Chen | |
| 7,955,126 | B2 | | 6/2011 | Bence | |
| 8,192,237 | B2 | * | 6/2012 | Purdy et al. | 439/792 |
| 8,313,345 | B2 | | 11/2012 | Purdy | |
| 8,323,060 | B2 | | 12/2012 | Purdy et al. | |
| 8,579,658 | B2 | | 11/2013 | Youtsey | |
| 2008/0248689 | A1 | * | 10/2008 | Montena | 439/583 |
| 2009/0098770 | A1 | | 4/2009 | Bence et al. | |
| 2011/0230091 | A1 | | 9/2011 | Krenceski et al. | |
| 2011/0306236 | A1 | | 12/2011 | D'Addario et al. | |
| 2012/0045933 | A1 | * | 2/2012 | Youtsey | 439/578 |
| 2012/0270428 | A1 | * | 10/2012 | Purdy et al. | 439/277 |
| 2013/0102189 | A1 | | 4/2013 | Montena | |

* cited by examiner

COAXIAL CONNECTOR GROUNDING INSERTS

PRIORITY AND INCORPORATION BY REFERENCE

This application is a continuation of U.S. patent application Ser. No. 13/373,782 filed on Nov. 30, 2011, which is incorporated herein by reference in its entirety and for all purposes.

BACKGROUND OF THE INVENTION

1. Field of the Invention

The present invention relates generally to coaxial cable connectors. More particularly, the present invention relates to coaxial F-connectors adapted to insure the establishment of a proper ground during installation. Known prior art is classified in United States Patent Class 439, Subclasses 241, 247, 322, 548, 553, 554, 585, and 587.

2. Description of the Related Art

Popular cable television systems and satellite television receiving systems depend upon coaxial cable for distributing signals. As is known in the satellite TV arts, coaxial cable in such installations is terminated by F-connectors that threadably establish the necessary signal wiring connections. The F-connector forms a "male" connection portion that fits to a variety of receptacles, forming the "female" portion of the connection.

F-connectors include a tubular post designed to slide over coaxial cable dielectric material and under the outer conductor at the prepared end of the coaxial cable. The exposed, conductive sheath is usually folded back over the cable jacket. The cable jacket and folded-back outer conductor extend generally around the outside of the tubular post and are typically coaxially received within the tubular connector. A continuity contact between the sheath and conductive portions of the connector is needed. Moreover, electrical contact must be made with the threaded head or nut of the connector that should contact the female socket to which the connection is made.

F-connectors have numerous advantages over other known fittings, such as RCA, BNC, and PL-259 connectors, in that no soldering is needed for installation, and costs are reduced as parts are minimized. For example, with an F-connector, the center conductor of a properly prepared coaxial cable fitted to it forms the "male" portion of the receptacle connection, and no separate part is needed. A wide variety of F-connectors are known in the art, including the popular compression type connector that aids in rapid assembly and installation. Hundreds of such connectors are seen in U.S. Patent Class 439, particularly Subclass 548.

However, the extremely high bandwidths and frequencies distributed in conjunction with modern satellite installations necessitates a variety of strict quality control factors. For example, the electrical connection established by the F-connector must not add electrical resistance to the circuit. It must exhibit a proper surge impedance to maintain a wide bandwidth, in the order of several Gigahertz. Numerous physical design requirements exist as well. For example, connectors must maintain a proper seal against the environment, and they must function over long time periods through extreme weather and temperature conditions. Requirements exist governing frictional insertion and disconnection or withdrawal forces as well.

Importantly, since a variety of coaxial cable diameters exist, it is imperative that satisfactory F-connectors function with differently sized cables, such as RG-6 and RG-59 coaxial cables that are most popular in the satellite television art.

It is important to establish an effective electrical connection between the F-connector, the internal coaxial cable, and the terminal socket. Proper installation techniques require adequate torquing of the connector head. In other words, it is desired that the installer appropriately tighten the connector during installation. A dependable electrical grounding path must be established through the connector body to the grounded shield or jacket of the coaxial cable. Threaded F-connector nuts should be installed with a wrench to establish reasonable torque settings. Critical tightening of the F nut to the threaded female socket or fixture applies enough pressure to the inner conductor of the coaxial cable to establish proper electrical connections. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

Many connector installations, however, are not properly completed. It is a simple fact in the satellite and cable television industries that many F-connectors are not appropriately tightened by the installer. The common instillation technique is to torque the F-connector with a small wrench during installation. In some cases installers only partially tighten the F-connector. Some installations are only hand-tightened. As a consequence, proper electrical continuity may not be achieved. Such F-connectors will not be properly "grounded," and the electrical grounding path can be compromised and can become intermittent. An appropriate low resistance, low loss connection to the female target socket, and the equipment connected to it, will not be established. Unless an alternate ground path exists, poor signal quality, and RFI leakage, will result. This translates to signal loss or degradation to the customer.

U.S. Pat. No. 3,678,445 issued Jul. 18, 1972 discloses a shield for eliminating electromagnetic interference in an electrical connector. A conductive shielding member having a spring portion snaps into a groove for removably securing the shield. A second spring portion is yieldable to provide electrical contact between the first shell member and a second movable shell member.

U.S. Pat. No. 3,835,443 issued Sep. 10, 1974 discloses an electromagnetic interference shield for an electrical connector comprising a helically coiled conductive spring interposed between mating halves of the connector. The coiled spring has convolutions slanted at an oblique angle to the center axis of the connector. Mating of the connector members axially flattens the spring to form an almost continuous metal shield between the connector members.

U.S. Pat. No. 3,439,046 issued Jun. 12, 1973 discloses a coaxial connector with an internal, electrically conductive coil spring is mounted between adjacent portions of connector. As an end member is rotatably threaded toward the housing, an inwardly directed annular bevel engages the spring and moves it inwardly toward an electrically shielded portion of the cable. The spring is compressed circumferentially so that its inner periphery makes electrical grounding contact with the shielded portion of the cable.

U.S. Pat. No. 5,066,248 issued Nov. 19, 1991 discloses coaxial cable connector comprising a housing sleeve, a connector body, a locking ring, and a center post. A stepped annular collar on the connector body ensures metal-to-metal contact and grounding.

U.S. Pat. No. 4,106,839 issued Aug. 15, 1978 shows a coaxial connector with a resilient, annular insert between abutting connector pieces for grounding adjacent parts. A band having a cylindrical surface is seated against an internal surface. Folded, resilient fingers connected with the band are biased into contact. The shield has tabs for mounting, and a plurality of folded integral, resilient fingers for establishing a ground.

U.S. Pat. No. 4,423,919 issued Jan. 3, 1984 discloses a connector with having a cylindrical shell with radial flange, a longitudinal key, and a shielding ring fitted over the shell and adjacent to the flange. The shielding ring comprises a detent having end faces configured to abut connector portions when the detent fits within the keyway, whereby the shell is prevented from rotating.

U.S. Pat. No. 4,330,166 issued May 18, 1982 discloses an electrical connector substantially shielded against EMP and EMI energy with an internal, conductive spring washer seated in the plug portion of the connector. A wave washer made from beryllium copper alloy is preferred.

U.S. Pat. No. 6,406,330 issued Jun. 18, 2002 employs an internal, beryllium copper clip ring for grounding. The clip ring forms a ground circuit between a male member and a female member of the electrical connector. The clip ring includes an annular body having an inner wall and an outer wall comprising a plurality of circumferentially spaced slots.

U.S. Pat. No. 7,114,990 issued Oct. 3, 2006 discloses a coaxial cable connector with an internal grounding clip establishing a grounding path between an internal tubular post and the connector. The grounding clip comprises a C-shaped metal clip with an arcuate curvature that is non-circular. U.S. Pat. No. 7,479,035 issued Jan. 20, 2009 shows a similar F-connector grounding arrangement.

U.S. Pat. No. 7,753,705 issued Jul. 13, 2010 discloses an RF seal for coaxial connectors. The seal comprises a flexible brim, a transition band, and a tubular insert with an insert chamber defined within the seal. In a first embodiment the flexible brim is angled away from the insert chamber, and in a second embodiment the flexible brim is angled inward toward the insert chamber. A flange end of the seal makes a compliant contact between the port and connector faces when the nut of a connector is partially tightened, and becomes sandwiched firmly between the ground surfaces when the nut is properly tightened. U.S. Pat. No. 7,892,024 issued Feb. 22, 2011 shows a similar grounding insert for F-connectors.

U.S. Pat. No. 7,824,216 issued Nov. 2, 2010 discloses a coaxial connector comprising a body, a post including a flange having a tapered surface, and a nut having an internal lip with a tapered surface which oppositely corresponds to the tapered surface of the post when is assembled, and a conductive O-ring between the post and the nut for grounding or continuity. Similar U.S. Pat. No. 7,845,976 issued Dec. 7, 2010 and U.S. Pat. No. 7,892,005 issued Feb. 22, 2011 use conductive, internal O-rings for both grounding and sealing.

U.S. Pat. No. 6,332,815 issued Dec. 25, 2001 and U.S. Pat. No. 6,406,330 issued Jun. 18, 2002 utilize clip rings made of resilient, conductive material such as beryllium copper for grounding. The clip ring forms a ground between a male member and a female member of the connector.

U.S. Pat. No. 6,716,062 issued Apr. 6, 2004 discloses a coaxial cable F connector with an internal coiled spring that establishes continuity. The spring biases the nut toward a rest position wherein not more than three revolutions of the nut are necessary to bring the post of the connector into contact.

For an adequate design, structural improvements to compressible F-connectors for improving continuity or grounding must function reliably without degrading other important connector requirements. Compressible connectors must adequately compress during installation without excessive force. An environmental seal must be established to keep out water. The coaxial cable inserted into the connector must not be mechanically broken an short circuited during installation. Field installers and technicians must be satisfied with the ease of installation. Finally, the bottom line is that a reliable installation must result for customer satisfaction

BRIEF SUMMARY OF THE INVENTION

Our coaxial cable connectors are of the compressible type. The connectors comprise a rigid nut with a faceted drive head adapted to be torqued during installation of a fitting. The head has an internally threaded, tubular stem, for threadably mating with a typical socket or receptacle. An elongated post coupled to the nut includes a shank, which can be barbed, that engages the prepared end of a coaxial cable. An elongated, tubular body is coupled to the post. When the device is compressed, an end cap is press fitted to the body, coaxially engaging a body shank portion and closing the fitting.

In known F-connector designs the internal post establishes electrical contact between the coaxial cable sheath and metallic parts of the coaxial fitting, such as the nut. Also, the elongated, tubular shank extends from the post to engage the coaxial cable, making contact with the metallic, insulative sheath.

However, since improper or insufficient tightening of the nut during F-connector installation is so common, and since continuity and/or electrical grounding suffer as a result, our design includes internal grounding inserts that remedy the problem. All embodiments of our grounding insert include means for contacting and grasping the post, and means for contacting the nut, to establish a redundant grounding path between the nut, the post, and the coaxial cable to which the fitting is fastened.

A preferred grounding insert comprises a circular band, preferably made of beryllium copper alloy. In assembly, the grounding insert band coaxially engages the post. Multiple radially spaced spring clips defined around the band securely grasp a flange portion of the post. The band is seated within a ring groove within the nut, making electrical contact.

An alternative grounding insert comprises a tubular band for contacting and grasping the post flange. The band is integral with a flared, projecting skirt having a polygonal cross section. The skirt comprises a plurality of vertices and a plurality of facets therebetween. In assembly the band yieldably grasps the periphery of the post flange to establish electrical contact. Skirt vertices abut the nut's internal ring groove. Electrical contact between the insert, the post, the nut, and the coaxial cable is thus insured, despite insufficient tightening of the nut.

Thus the primary object of our invention is to provide suitable grounding within an F-connector to overcome electrical connection problems associated with improper installation.

More particularly, an object of our invention is to provide dependable electrical connections between coaxial connectors, especially F-connectors, and female connectors or sockets.

Another object of the present invention is to provide internal coaxial cable structure for establishing a grounding path in an improperly-tightened coaxial cable connector.

A similar object is to provide a proper ground, even though required torque settings have been ignored.

Another related object of the present invention to provide a reliable ground connection between a connector and a target socket or port, even if the connector is not fully tightened.

It is another object of the present invention to provide such a coaxial cable connector which establishes and maintains a reliable ground path.

It is still another object of the present invention to provide such a coaxial connector that can be manufactured economically.

Another object of our invention is to provide a connector of the character described that establishes satisfactory EMP, EMI, and RFI shielding.

A related object is to provide a connector of the character described that establishes a decent ground during installation of the male connector to the various types of threaded female connections even though applied torque may fail to meet specifications.

Another essential object is to establish a proper ground electrical path with a socket even where the male connector is not fully torqued to the proper settings.

Another important object is to minimize resistive losses in a coaxial cable junction.

A still further object is to provide a connector suitable for use with demanding large, bandwidth systems approximating three GHz.

A related object is to provide an F-connector ideally adapted for home satellite systems distributing multiple high definition television channels.

Another important object is to provide a connector of the character described that is weather proof and moisture resistant.

Another important object is to provide a compression F-connector of the character described that can be safely and properly installed without deformation of critical parts during final compression.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
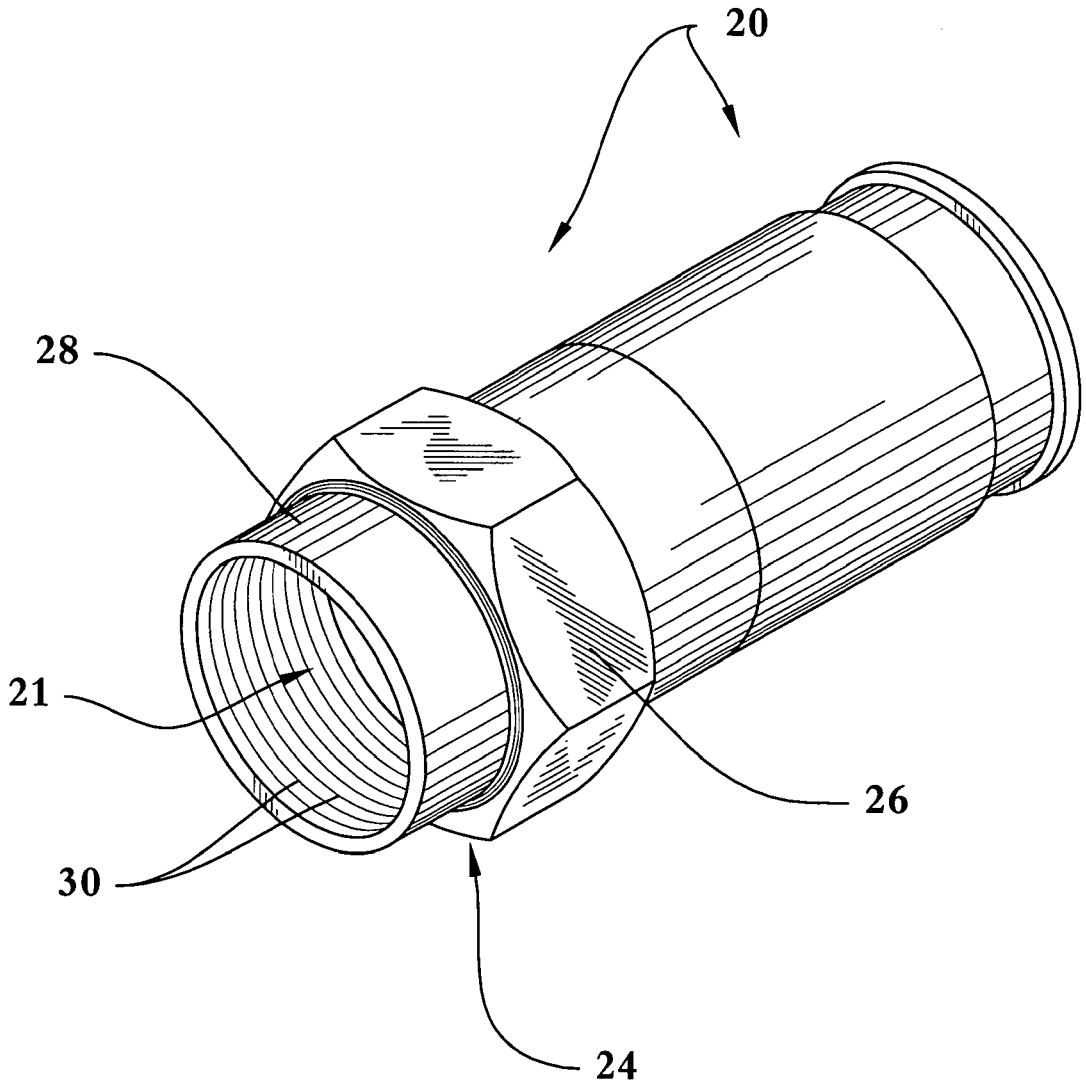
FIG. 1 is a frontal isometric view of a typical coaxial connector in which the instant grounding inserts are deployed.
Figure 2:
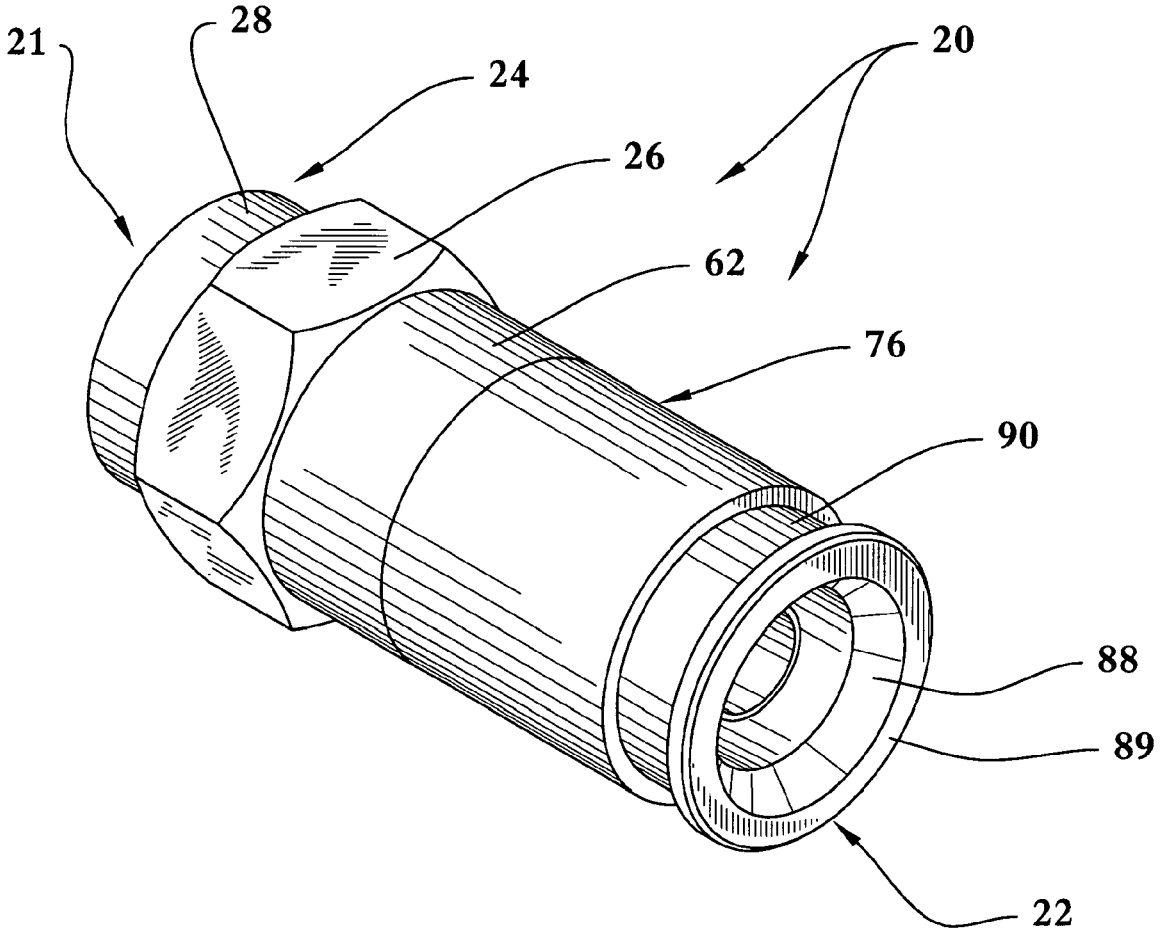
FIG. 2 is a rear isometric view of the connector of FIG. 1.
Figure 3:
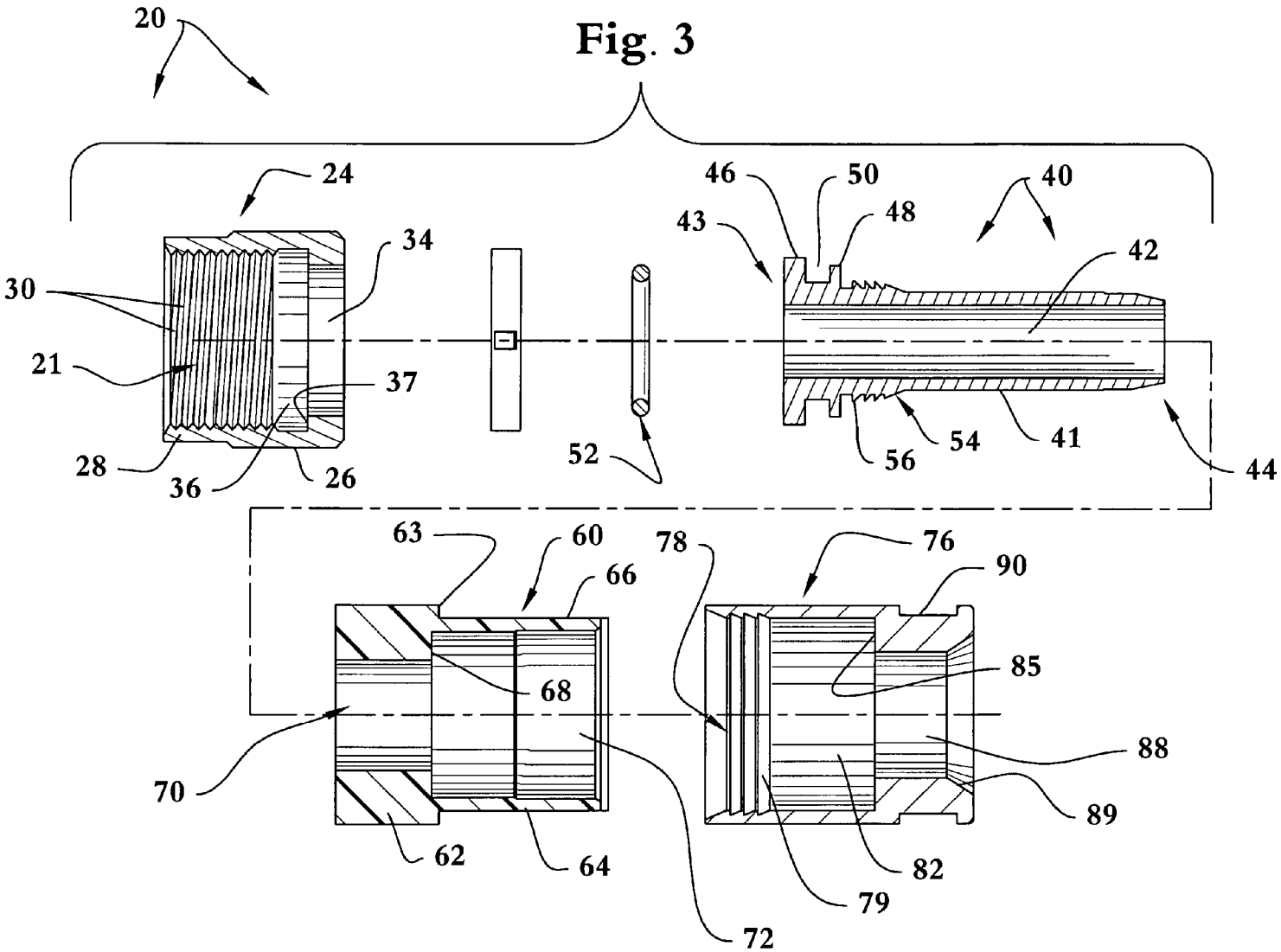
FIG. 3 is an exploded, longitudinal sectional view of the connector of FIGS. 1 and 2 showing the first embodiment of our grounding insert.
Figure 4:
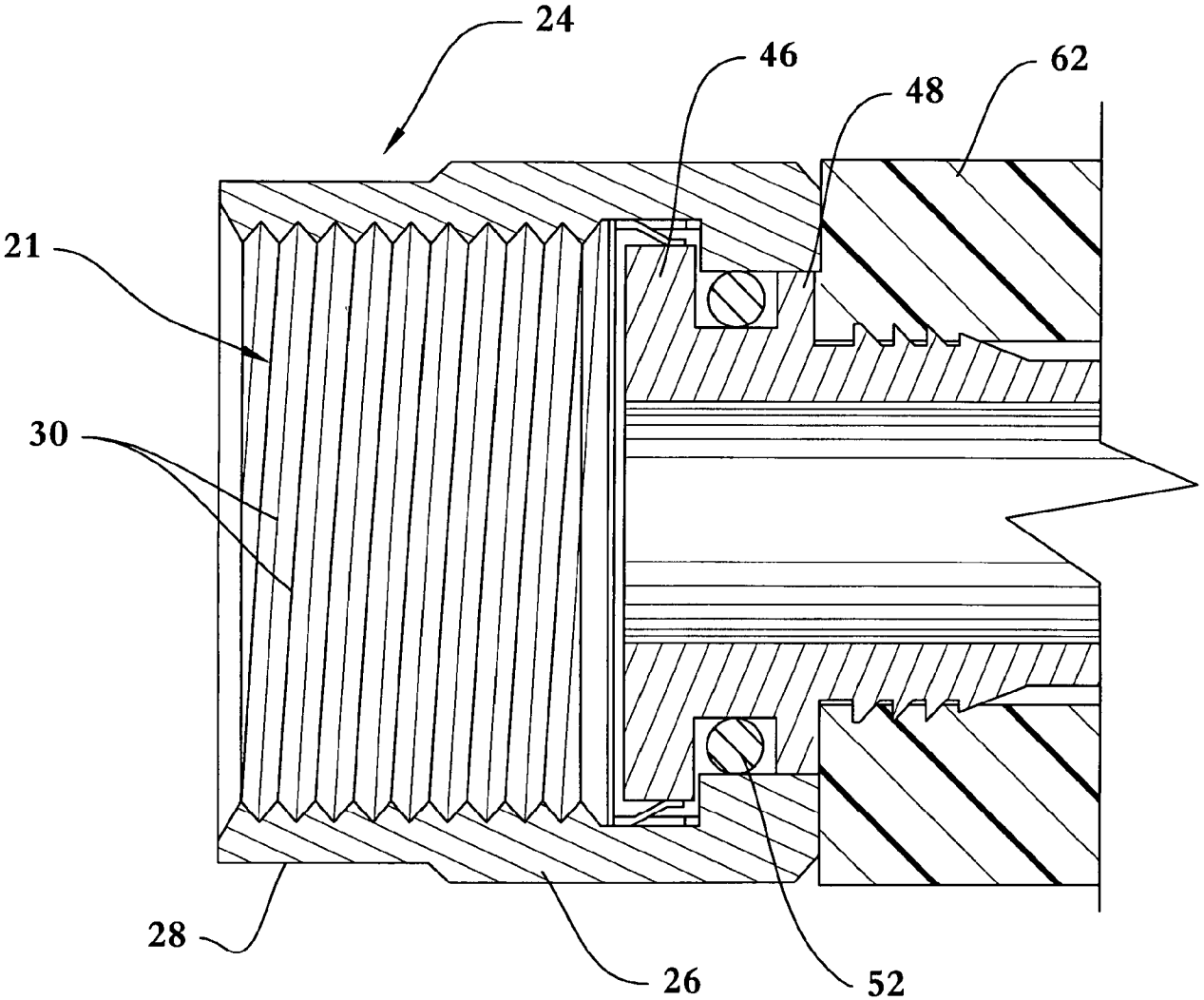
FIG. 4 is an enlarged, fragmentary assembly view of the connector of FIGS. 1-3 showing the first embodiment of our grounding insert, with portions thereof broken away or shown in section for clarity.

Coaxial cable F-connectors are well known in the art. The basic constituents of the coaxial connector of FIGS. 1 and 2 are described in detail, for example, in prior U.S. Pat. No. 7,841,896 entitled "Sealed compression type coaxial cable F-connectors", issued Nov. 30, 2010, and in prior U.S. Pat. No. 7,513,795, entitled "Compression type coaxial cable F-connectors", issued Apr. 7, 2009, which are both owned by the same assignee as in the instant case, and which are both hereby incorporated by reference for purposes of disclosure as if fully set forth herein. However, it will be appreciated by those with skill in the art that coaxial cable connectors of other designs may be employed with the grounding inserts described hereinafter.

Referring initially to FIGS. 1-4 of the appended drawings, a coaxial F-connector has been generally designated by the reference numeral 20. As will be recognized by those skilled in the art, connector 20 is a compressible F-connector, that is axially squeezed together longitudinally when secured to a coaxial cable. As is also recognized in the art, connector 20 is adapted to terminate an end of a properly prepared coaxial cable, which is properly inserted through the open bottom end 22 of the connector 20. Afterwards, the connector is placed within a suitable compression hand tool for compression, assuming the closed configuration of FIGS. 1 and 2 and making electrical contact with the cable.

Connector 20 comprises a rigid, tubular, metallic nut 24 with a conventional faceted, preferably hexagonal drive head 26 integral with a protruding, coaxial stem 28. Nut 24 is torqued during installation. Conventional, internal threads 30 are defined in the stem interior for rotatably, threadably mating with a suitably-threaded socket. The open, tubular front end 21 connects through the open interior to a reduced diameter rear passageway 34 at the back of nut 24. Circular passageway 34 concentrically borders an annular, non-threaded, internal ring groove 36 that borders an internal shoulder 37 proximate passageway 34.

An elongated post 40 rotatably, coaxially passes through the hex headed nut 24. In most F-connector designs the metallic post 40 establishes electrical contact between the braid of the coax and the metallic nut 24. The tubular post 40 defines an elongated shank 41 with a coaxial, internal passageway 42 extending between its front 43 and rear 44. Shank 41 may or may not have barbs formed on it for engaging coaxial cable. A front, annular flange 46 (FIG. 3) is spaced apart from an integral, reduced diameter flange 48, across a ring groove 50. A conventional, resilient O-ring 52 is preferably seated within post groove 50 when the connector 20 is assembled. O-ring 52 is preferably made of a silicone elastomer. A barbed, collar 54 having multiple, external barbs 56 is press fitted into the plastic body 60 described below. In assembly it is noted that post flange 46 (i.e., FIGS. 3, 4) axially contacts inner shoulder 37 (FIG. 4) within nut 24 Inner post flange 48 and the O-ring 52 are coaxially, frictionally disposed within passageway 34 at the rear of nut 24.

The rear tapered end 44 of post shank 41 penetrates the prepared end of the coaxial cable, such that the inner, insulated coaxial cable conductor penetrates passageway 42 and enters the front 21 of the nut 24. Also, the braided shield of the coax is positioned around the exterior of post shank 41, making electrical contact, and hopefully establishing a good ground, or continuity between the coaxial cable sheath, the post 40, and the nut 24.

An elongated, hollow, tubular body 60, normally molded from plastic, is coupled to the post 40. Body 60 preferably comprises a tubular stop ring 62 that is integral with a reduced diameter body shank 64. The elongated, outer periphery 66 of shank 64 is smooth and cylindrical. The larger diameter stop ring 62 has an annular, rear wall 68 that is coaxial with shank 64. Ring 62 defines an internal passageway 70 through which the post 40 is inserted. In assembly, the barbed post collar 54 is frictionally seated within body passageway 70.

An end cap 76 is pressed unto body 60, coaxially engaging the body shank 64. The rigid, preferably metallic end cap 76 smoothly, frictionally grips body shank 64, with maximum travel or displacement limited by stop ring 62. In other words, when the end cap 76 is compressed unto the body 60, and the connector 20 assumes a closed position (i.e., FIG. 2), annular wall 63 on the body stop ring 62 will limit deflection or travel of the end cap 76. Preferably the open end 78 of the end cap includes internally barbed region 79 that couples to the shank 64 of the body 60. When the body 60 and the cap 76 are compressed together, body travel is limited within cap passageway 82 by contact with internal cap shoulder 85. The reduced diameter passageway 88 is sized to receive coaxial cable, which is inserted through the flared opening 89. An outer ring groove 90 at the cap rear can seat a desired O-ring.

In most F-connectors, grounding or continuity is established by mechanical and electrical contact points between abutting, conductive, metallic parts. Noting FIGS. 3 and 4, for example, normal grounding should occur between nut shoulder 37 and post flange 46. The coaxial cable sheath bearing against the post shank 41 would thus electrically interconnect with the post and the nut 24, which would in turn establish electrical contact with the socket to which nut 24 is attached. However, grounding or continuity depend on proper tightening of the nut 24. In the real world, installers often neglect to properly tighten the nut, so less internal, mechanical pressure is available within the F-connector to urge the parts discussed above into abutting, conductive contact.

Figure 7:
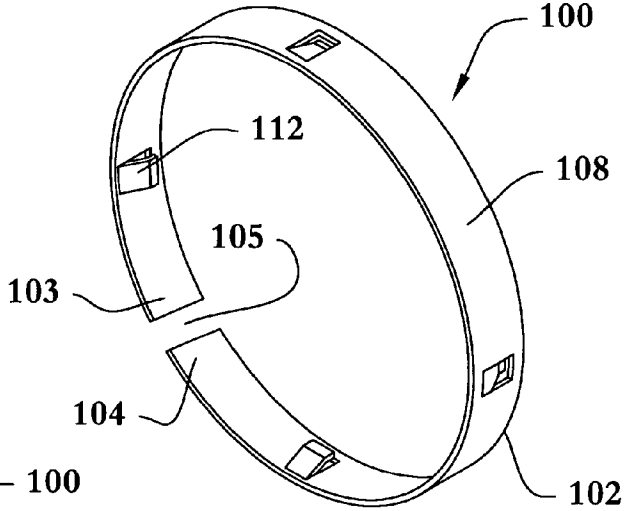
FIG. 7 is an enlarged, isometric view of the grounding insert of FIGS. 3-6.
Figure 6:
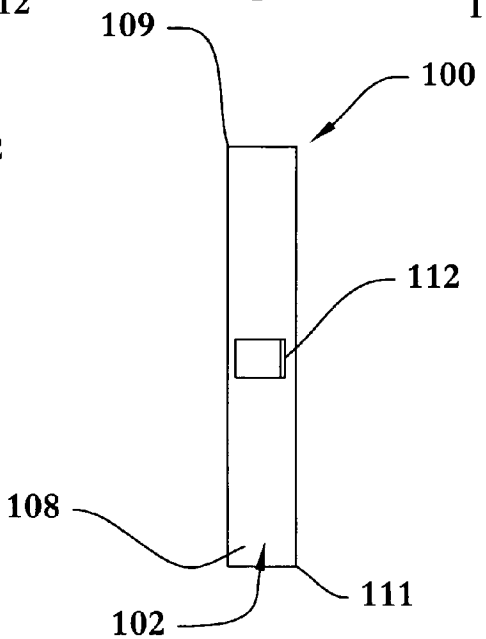
FIG. 6 is an enlarged, side elevational view of the grounding insert of FIGS. 3-5.
Figure 5:
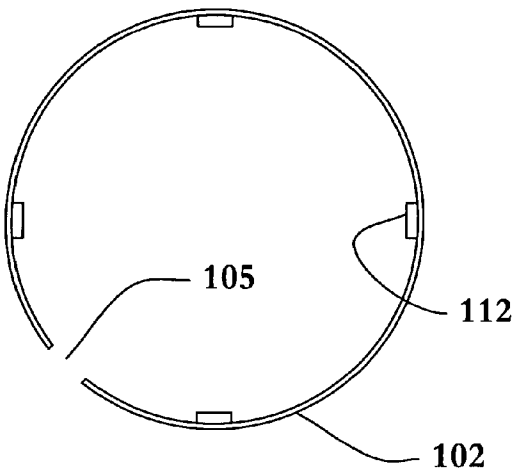
FIG. 5 is an enlarged end view of a first embodiment of our grounding insert.
Figure 8:
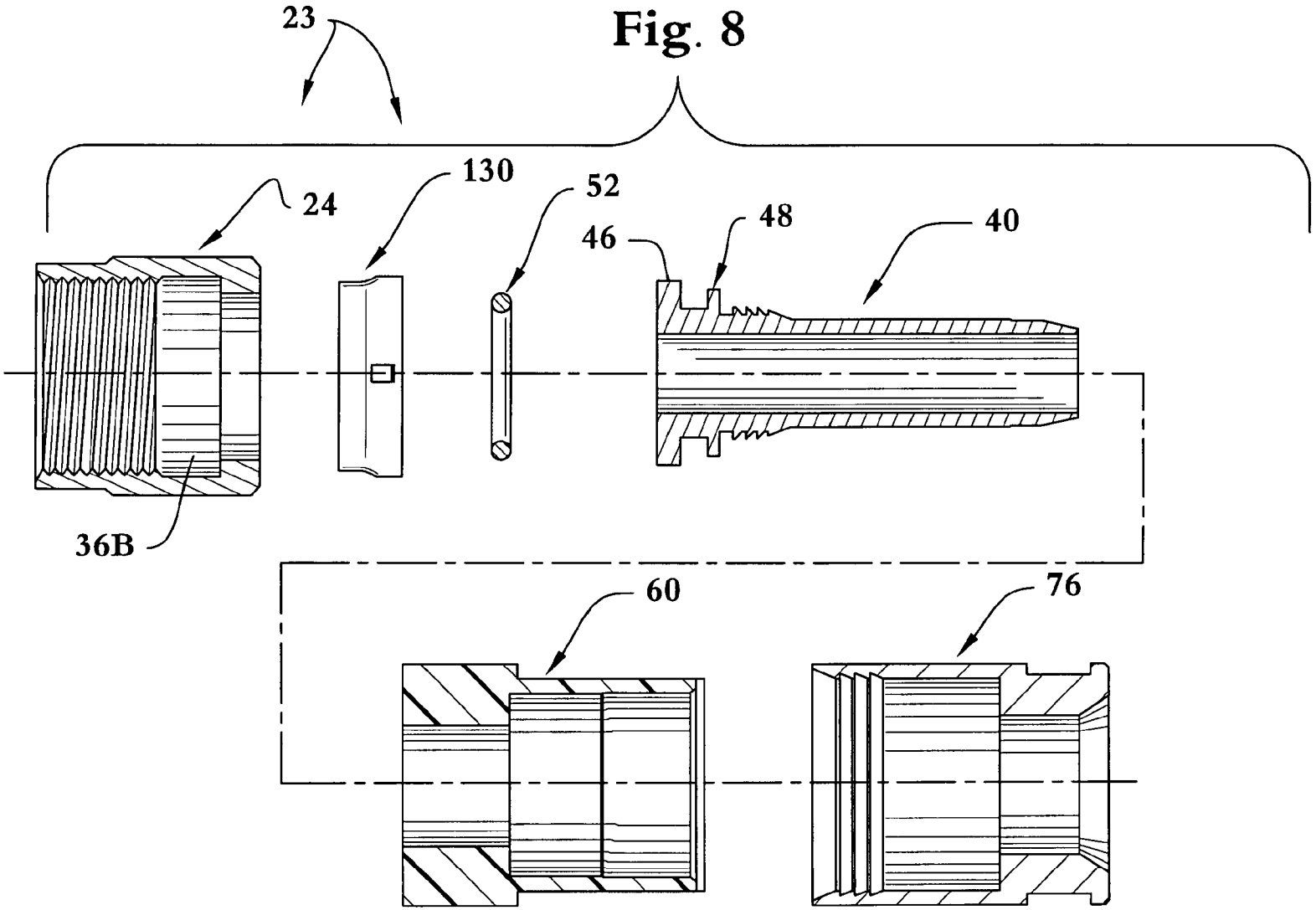
FIG. 8 is an exploded, longitudinal sectional view of a connector such as that of FIGS. 1-2, showing the second embodiment of our grounding insert.
Figure 9:
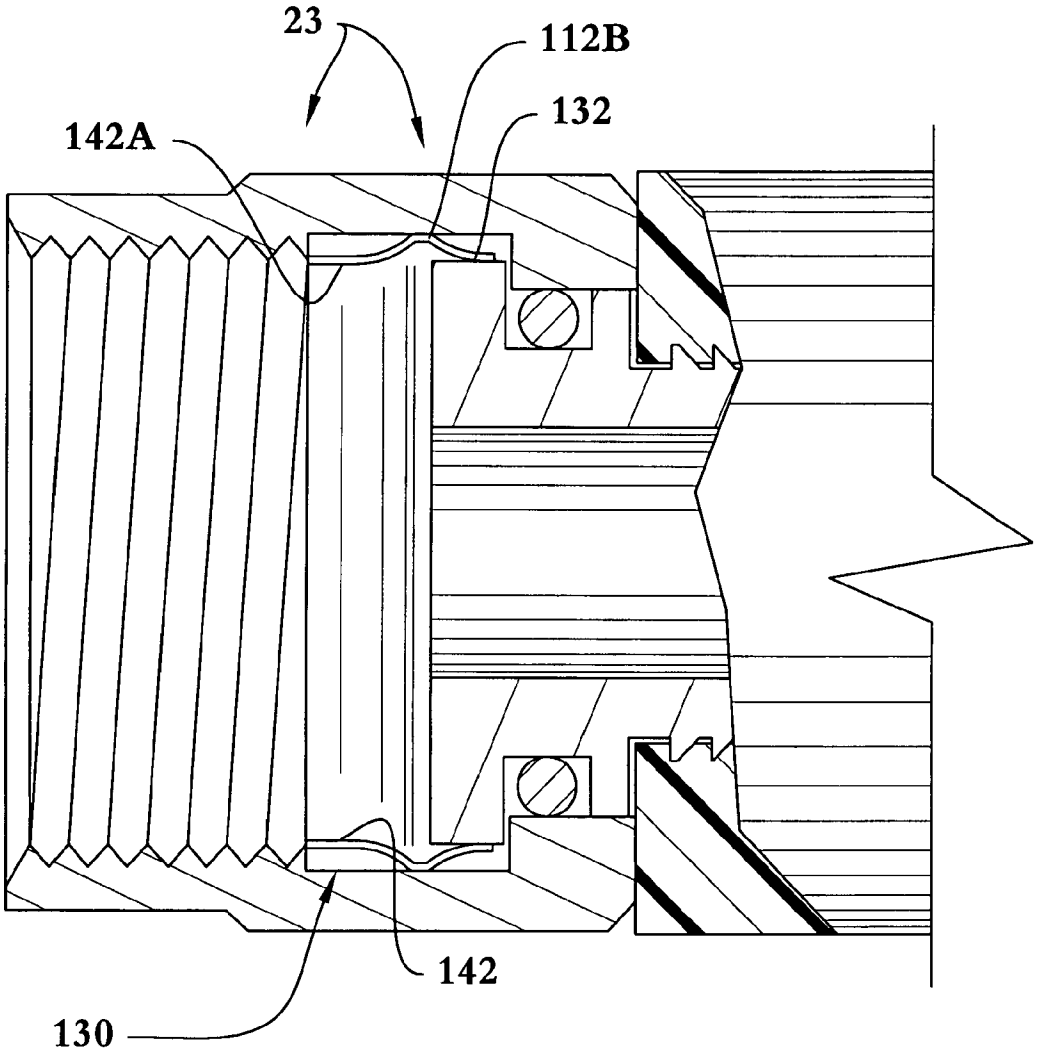
FIG. 9 is an enlarged, fragmentary assembly view showing the grounding insert of FIGS. 5-7, with portions thereof broken away or shown in section for clarity.
Figure 11:
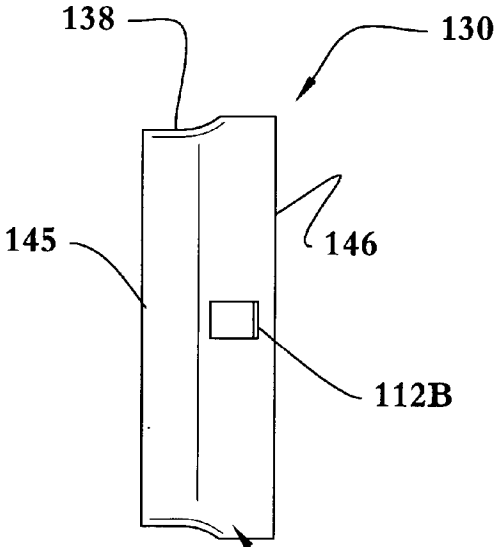
FIG. 11 is a side elevational view of the second embodiment of our grounding insert.
Figure 12:
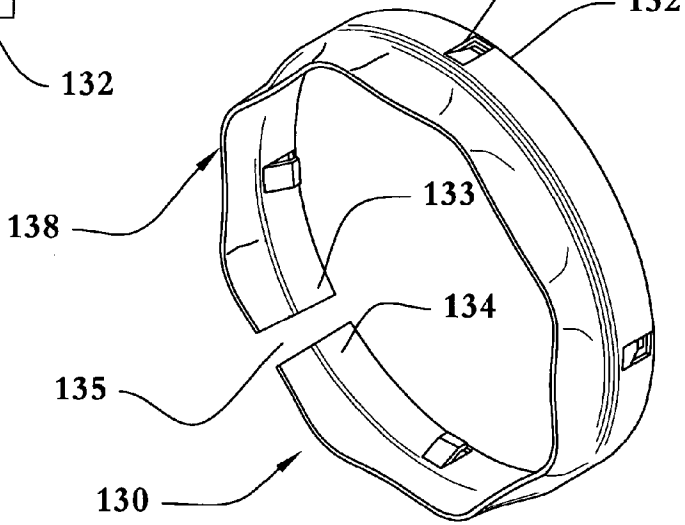
FIG. 12 is an isometric view of the second embodiment of out grounding insert of FIGS. 10 and 11; and, FIG. 13 is an enlarged sectional view similar to FIG. 9, but showing the connector threadably mated to a threaded socket.

Therefore our electrical grounding inserts have been proposed. The first embodiment of our insert is generally designated by the reference numeral 100 (FIGS. 5-7.)

Ground insert 100 comprises an annular, circular band 102 of beryllium copper alloy. Means are provided for contacting and grasping the post flange, and for contacting the nut interior. Insert ends 103 and 104 border one another across a gap 105. As best viewed in FIG. 6, the band midsection 108 is substantially equal in diameter to the opposite, integral spaced apart band edges 109 and 111. It will be noted that a plurality of radially, spaced apart clips 112 are formed at regular intervals along the circumference of the band 102. Preferably clips 112 project inwardly towards the center of the band 102.

In assembly, the grounding insert 100 coaxially surmounts the post 40. Specifically, the band 102 coaxially seats upon post flange 46 which is securely grasped at multiple points by the clips 112. Insert resilience is provided by a combination of the natural "springiness" of the beryllium copper alloy, the gap 105, and the multiple clips 112 that yieldably grasp the periphery of post flange 46. Electrical contact between the insert and the post is thus insured by clips 112. Electric contact between the insert 100 and the nut 24 is insured by the band 102 coaxially seated within annular ring groove 36 (FIG. 3) and the clip end 111 (FIG. 6) that internally abuts nut shoulder 37 (i.e., FIGS. 3, 4).

The alternative embodiment is seen in FIGS. 8-12. Alternative F-connector 23, is externally identical with connector 20, discussed above. However. connector 23 includes a modified grounding insert 130 described hereinafter. Like connector 20, the alternative connector 23 comprises a nut 24, a post 40, a body 60 and an end cap 76, all of which are described above.

Figure 10:
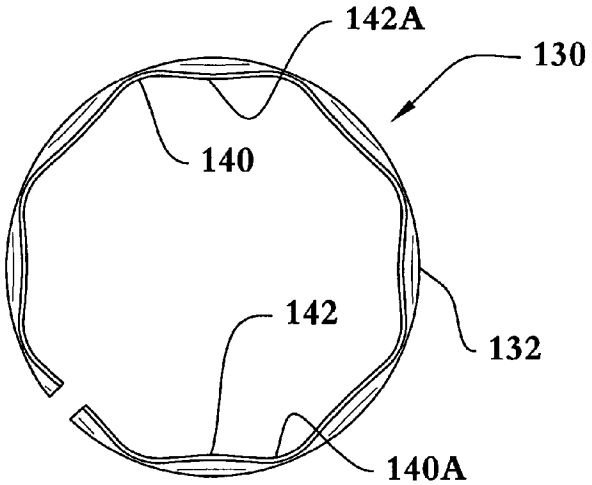
FIG. 10 is an end view of the second embodiment of our grounding insert.

Ground insert 130 comprises means for contacting and grasping the post flange, and for contacting the nut interior. Insert 130 comprises a tubular band 132 of beryllium copper alloy for contacting and grasping the post flange. The cross section of insert 130 is circular. Ends 133 and 134 border one another across a gap 135. Band 132 is integral with a flared, skirt 138 characterized by a polygonal cross section (FIG. 10). Like a regular polygon, skirt 138 comprises a plurality of vertices 140 and a plurality of facets 142. The diameter of skirt 138 is maximum, and equal to the diameter of band 132, between opposed vertices (i.e., between vertices 140 and 140A in FIG. 10). The gently curved facets 143 establish a smaller internal diameter. For example, the distance between opposite facets 142 and 142A in FIG. 10, corresponding to minimal skirt diameter, is less than the distance between vertices 140 and 140A.

Preferably, band 132 is provided with a plurality of radially, spaced apart clips 112B like clips 112 previously described that are defined around insert 100. In assembly, clips 112B make contact with the post flange 46 within the ring groove 36B.

In assembly (FIG. 9), the front 145 of grounding insert 130 points exteriorly of the connector 23 towards nut 24. The insert rear 146 (FIG. 11) points inwardly. Band 132 coaxially seats upon a post flange 46 and yieldably grasps the periphery of the flange to establish electrical contact with the post. In assembly, band 132 occupies space between flange post 46 and internal annular ring groove 36 in nut 24. Skirt vertices 140 abut the annular ring groove 36B (i.e., FIGS. 8, 9) in the nut. It is to be noted that ring groove 36B is longer than similar groove 36 in connector 20, as the insert 130 is longer than insert 100.

Figure 13:
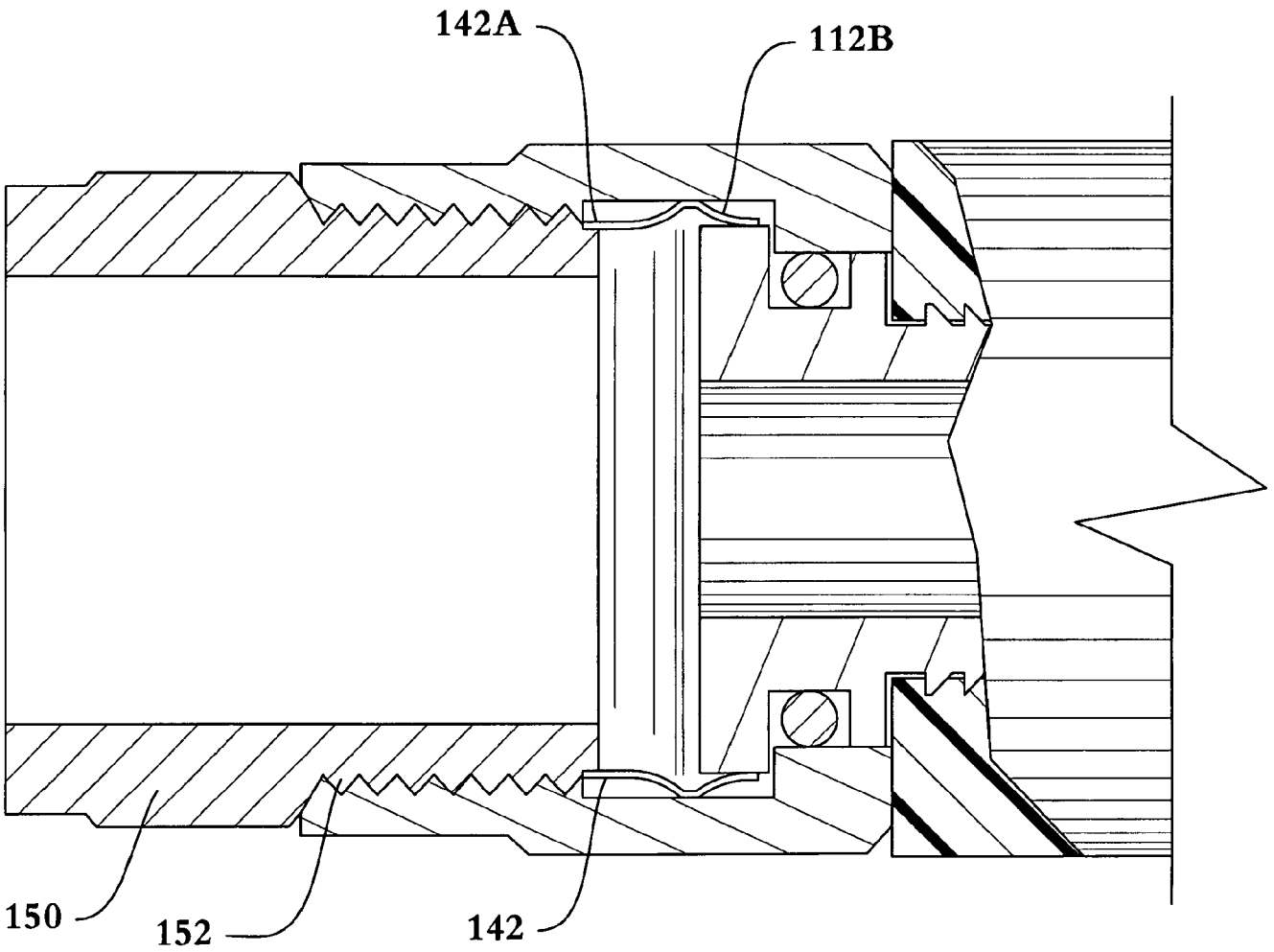

Further electrical continuity is established by skirt contact with the socket or terminal to which the connector is coupled. Referencing FIG. 13, the connector has engaged a conventional socket 150 that includes the typical external threads 152. When the connector is attached, the skirt facets, such as facets 142, 142A will externally contact a portion of the socket threads to help establish continuity between the socket 152 and the connector.

Insert resilience is provided by a combination of the natural "springiness" of the beryllium copper alloy, the gap 135, and the multiple facets 142 and vertices 140 of the skirt configuration. Electrical contact between the insert 130 and the post 40 is thus insured. Electric contact between the insert 130 and the nut 24 is also maintained.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method of establishing a ground and promoting electrical continuity through a coaxial connector, the method comprising:

providing a threaded nut adapted to threadably fasten the connector, the nut including an interior;

providing an elongated, hollow post, the post including a portion that internally abuts the nut;

mechanically coupling said post to said nut;

coaxially disposing a hollow, tubular body over said post;

slidably coupling a tubular end cap to said body; and providing an insert including a post adjacent means and nut adjacent means;

wherein an electrically conductive path is achieved between the nut and the post through the insert by simultaneously:

contacting and grasping the post with said post adjacent means; and contacting the nut interior with said nut adjacent means.

2. The method of claim 1, wherein the insert comprises a resilient circular band for contacting the nut interior and a plurality of clips formed on the band for grasping said post.

3. The method of claim 1, wherein the insert comprises a resilient band having a polygonal cross section for contacting the nut interior and grasping said post.

4. The method of claim 3, wherein said band comprises a plurality of radially spaced apart vertices and a plurality of radially spaced apart facets, the vertices interiorly contacting said nut interior and the facets grasping said post.

5. The method of claim 1, wherein the insert has a pair of ends separated from one another across a gap.

* * * * *